US005946954A

United States Patent [19]

Emery et al.

[11] Patent Number: 5,946,954

[45] Date of Patent: Sep. 7, 1999

[54] DOOR BUSHING SYSTEM FOR INSULATED STEEL SHELL SAFE

[75] Inventors: Leland E. Emery, Avon; Kelvin H. Wildman, Honeoye Falls; David A. Nowicky, Fairport, all of N.Y.

[73] Assignee: John D. Brush & Co., Inc., Rochester, N.Y.

[21] Appl. No.: 08/922,409

[22] Filed: Sep. 3, 1997

[51] Int. Cl.[6] ..... E05G 1/026

[52] U.S. Cl. ..... 70/213; 70/326; 70/329; 70/332; 70/443; 109/259 T; 109/76; 109/84

[58] Field of Search ..... 70/81, 82, 210, 70/213, 219, 301, 302, 303 R, 303 A, 326–329, 332, 443–445; 109/58, 59 R, 59 T, 64, 73–85

[56] References Cited

U.S. PATENT DOCUMENTS

| | | | |
|---|---|---|---|
| 287,955 | 11/1883 | Mosler | 109/64 X |
| 289,124 | 11/1883 | Mosler | 109/84 |
| 296,643 | 4/1884 | Stockwell | 109/84 |
| 1,749,222 | 3/1930 | Merriam | 109/74 |
| 1,868,485 | 7/1932 | Bates, Jr. | 109/75 |
| 2,726,625 | 12/1955 | Evans | 109/76 X |
| 2,750,901 | 6/1956 | McClellan | 109/59 R |
| 2,803,203 | 8/1957 | Henkel | 109/59 R |
| 2,804,364 | 8/1957 | Belew | 109/59 R X |
| 2,887,965 | 5/1959 | Henkel et al. | 109/59 R |
| 4,048,926 | 9/1977 | Brush, Jr. et al. | 109/75 X |
| 4,158,338 | 6/1979 | Dippold et al. | 109/83 X |
| 4,376,380 | 3/1983 | Burgess | 70/329 X |
| 4,422,386 | 12/1983 | Carpenter | 109/84 X |
| 4,468,943 | 9/1984 | Beattie et al. | 70/303 A X |
| 4,593,627 | 6/1986 | Lankard et al. | 109/83 |
| 4,683,732 | 8/1987 | Beattie | 109/59 R X |
| 4,691,544 | 9/1987 | Beattie | 70/329 |
| 4,977,766 | 12/1990 | Beattie et al. | 70/326 |
| 5,009,090 | 4/1991 | Beattie et al. | 70/326 |
| 5,632,166 | 5/1997 | Wiersma | 70/82 X |

*Primary Examiner*—Lloyd A. Gall
*Attorney, Agent, or Firm*—Eugene Stephens & Associates

[57] ABSTRACT

A door bushing system includes bushings formed as part of a molded resin door jamb in an insulated steel shell safe door. The mold for the door jamb is designed to form as many bushings as are required and can also form stubs or sleeves for mounting other safe components. The bushings can support parts of such components as combination locks, key locks, and door handles. The combination lock and the handle have spindles whose opposite ends have identical configurations to facilitate assembly. The spindles are also made from resinous material to reduce heat transmission and to allow attachment by insert molding. Because the bushings are installed automatically with the door jamb, this door bushing system eliminates the need for separate installation of bushings after assembly of the door, ensuring proper alignment and reducing costs.

37 Claims, 5 Drawing Sheets

DOOR BUSHING SYSTEM FOR INSULATED STEEL SHELL SAFE

TECHNICAL FIELD

Fire-resistant safes.

BACKGROUND

Bushing systems in prior art doors for insulated steel shell safes suffer from a number of disadvantages, but must be used to support rotatable components such as combination locks, key-operated locks, and handles. All of these components are accessed from outside the safe, rotate, and interact with additional components on the inner surface of the door. Components such as locks and handles each have one or more parts on the exterior of the door attached to a rotatable spindle extending through the door, the spindle also being attached to additional components on the interior of the door. The bushing system allows rotation of the spindles; provides support for the spindles and other components; and allows the spindles to pass through the door's front plate, insulation and jamb. In addition, the bushing system typically serves as a mount for internal components of the safe, such as tumbler discs or live bolt drivers.

Prior art bushing systems generally use individual bushings installed during assembly of the door. Each bushing comprises a series of parts that must themselves be assembled during installation. A prior art bushing assembly typically comprises a metal or resin tube through which a spindle passes. The tube passes through the door and is flanged on each end or otherwise secured to prevent longitudinal motion of the tube. The spindle is attached to a knob or handle at one end and a driver for internal safe components at the other end. A stub is mounted about the inner or rearward end of the tube and supports rotatable internal components of the safe, such as tumbler discs of a combination lock. The stub is held in place by a flange or the like extending into the insulation of the safe door as well as a shoulder bearing on the inner surface of the door. Alternatively, a plate attached to the stub screws into the inner or rearward surface of the safe door, allowing alignment adjustment by shimming of the plate. Another system includes a disc spring that allows the bushing to be somewhat out of alignment without interfering with operation of the rotatable components.

One disadvantage of conventional bushing systems is the difficulty of aligning and orienting all the bushing parts. This is especially true of post-pour installation of bushings in doors using concrete insulation, since precise alignment of a drill during boring of holes through concrete is often difficult to achieve. While some prior art systems allow adjustment of bushing alignment or tolerate some misalignment, there is a need for a bushing system that provides proper alignment and orientation of the bushings more consistently than conventional bushing systems.

A contributing factor to the bushing alignment problem is the number of parts in prior art bushing systems. Each part that must be installed is a source of alignment error and adds to installation duration. Thus, there is also a need for bushing systems with fewer parts to reduce alignment errors and installation time.

An additional disadvantage of conventional bushing systems that include metal pass-through tubes is heat conduction into the interior of the safe. While less heat-conductive bushing systems are in existence, there is still a need for bushing systems with reduced heat conduction into safe interiors. Thus, there is a need for a bushing system that is more consistently and easily aligned, has fewer parts, and conducts less heat than prior art bushing systems.

SUMMARY OF THE INVENTION

Our invention provides a bushing system that obviates separate installation of bushings during assembly of a safe door and greatly reduces the number of parts to be installed. Our bushing system provides bushings that are consistently aligned in the door, allowing free and proper movement of the parts mounted in and on the bushings. Additionally, as compared to bushing systems using metal pass-through tubes, our bushing system greatly reduces the amount of heat conducted into the interior of the safe.

Our new safe door bushing system places bushings in the safe door before the insulation is added. However, unlike prior art bushing systems, the bushings are part of the jamb of the door. The mold for a molded resin door jamb forms the jamb and the bushings as an integral bushing system. When the front plate of the door is attached to the jamb, this automatically installs and aligns the bushings since they are part of the jamb. Further, the jamb mold can be designed to form stubs or sleeves on the interior ends of the bushings. Safe components, such as tumbler discs and live bolt drivers, can be mounted on the outer surfaces of the stubs or sleeve on the interior region of the safe door.

Use of our bushing system simplifies quality control by virtue of the reduced number of parts in the system and the automatic, one-step installation of the bushings. Proper alignment of the bushings is achieved much more easily and consistently. Also, our bushing system conducts less heat into the interior of the safe because it is preferably made entirely of molded resin. Thus, our bushing system allows safe interiors to remain cooler longer than conventional bushing systems that include metal parts.

An additional advantage of our bushing system is the use of resinous spindles with identical end configurations. Because both ends of each spindle are identical, it does not matter which end is attached to other components. This makes assembly of the system much easier. Also, the spindles can be insert molded into other components, such as lock knobs, to provide a secure fit.

DETAILED DESCRIPTION OF THE INVENTION

Figure 1:
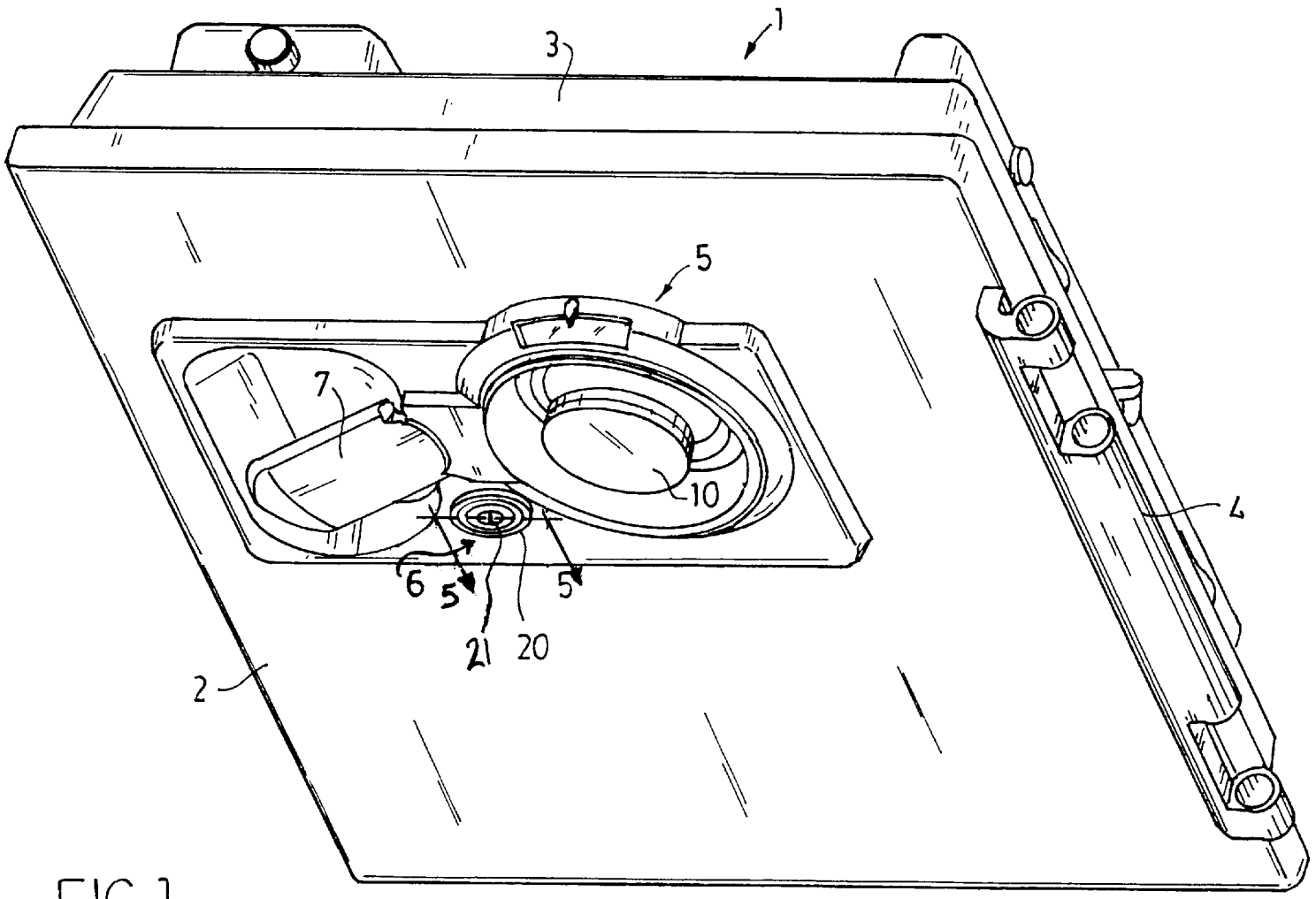
FIG.1 is a front perspective view of a complete door for a steel shell safe.
Figure 2:
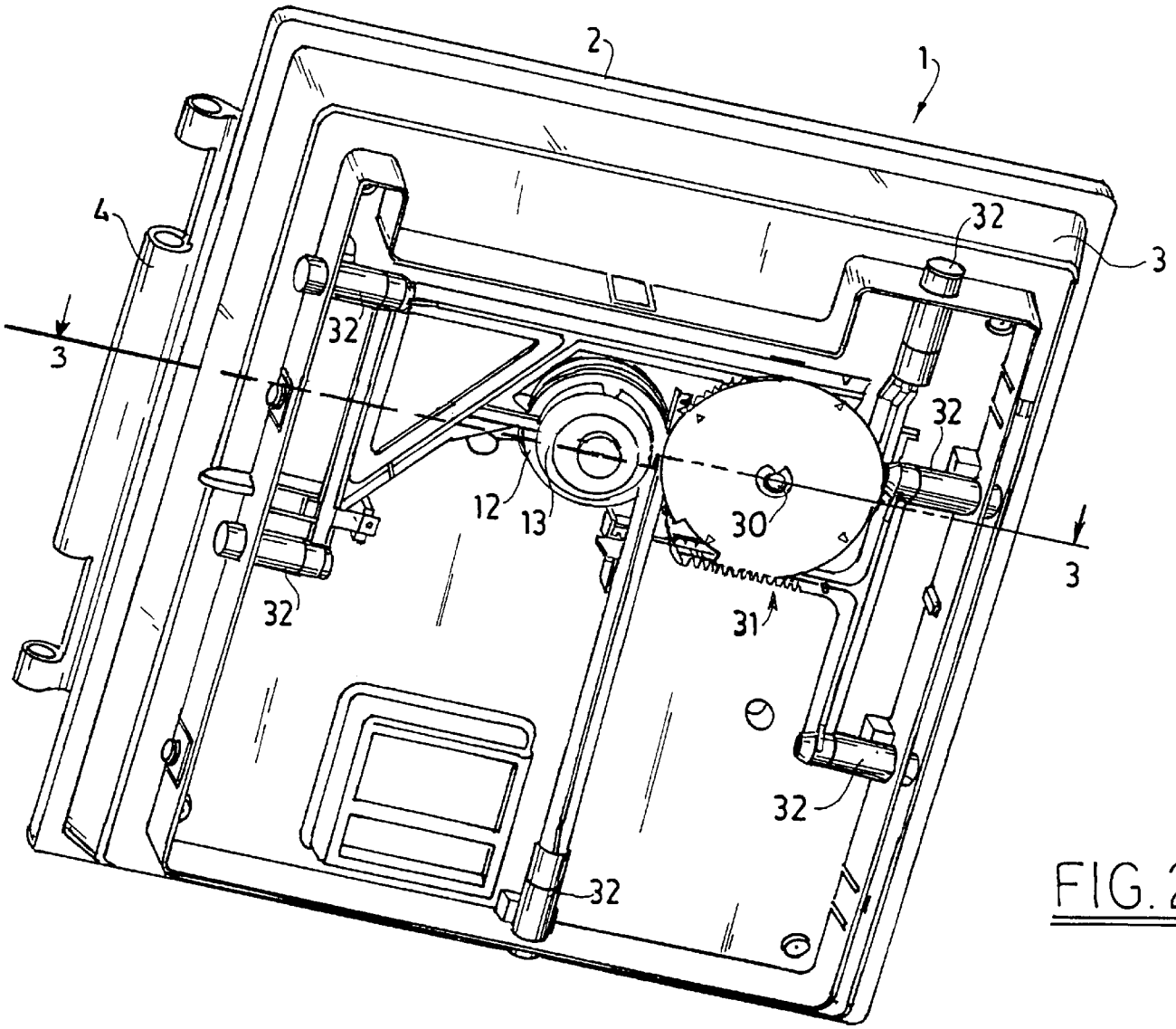
FIG. 2 is a rear perspective view of the door of FIG. 1.
Figure 3:
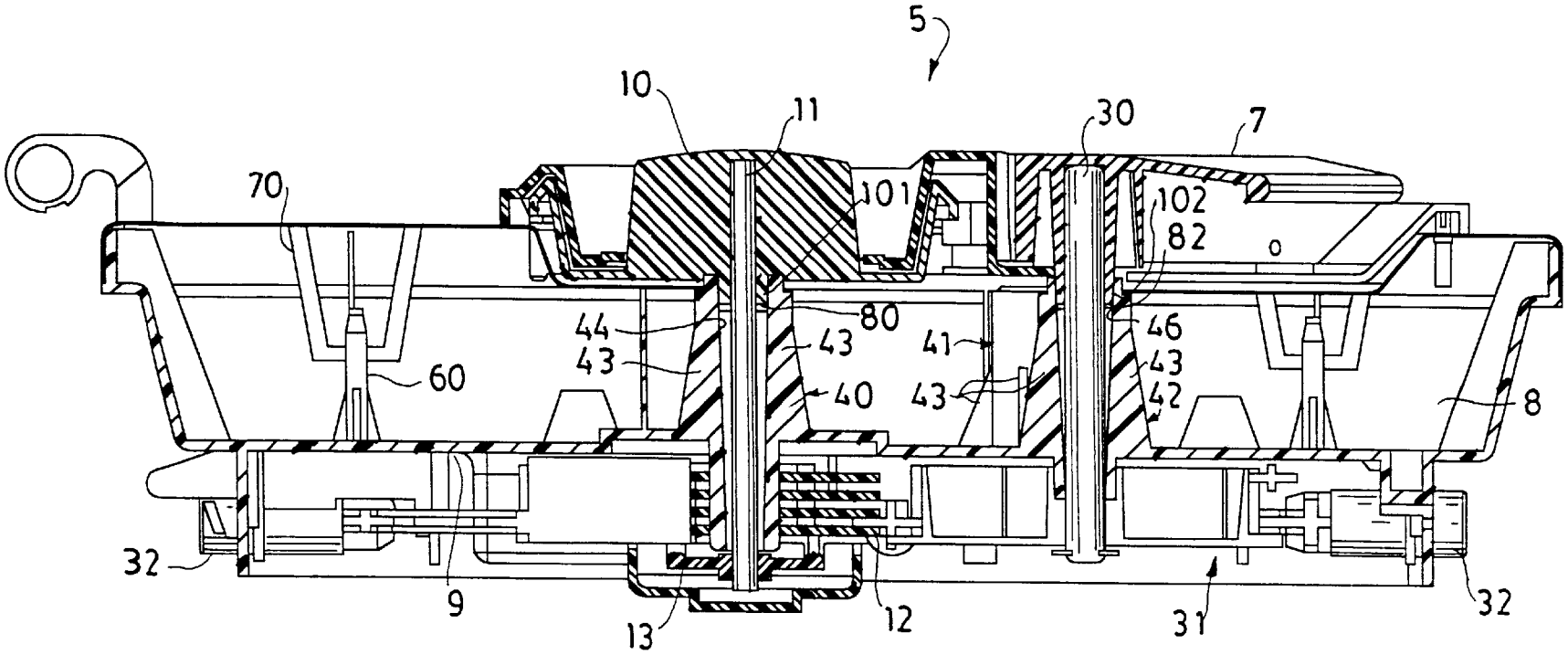
FIG. 3 is a cross section of the door of FIGS. 1 and 2 taken along line 3—3 in FIG. 2.

As seen in FIGS. 1–3, a door 1 for a steel shell safe (not shown) includes a front door plate 2, a jamb 3 attached to the back of door plate 2, and a hinge 4. The door plate 2 is preferably made of steel. A combination lock 5, a key-operated lock 6, and a handle 7 can all preferably be mounted on the door 1. The key-operated lock 6 can serve as a day lock. Insulative material 8 fills the space between the front door plate 2 and the jamb 3. While any suitable insulation 8 can be used, the preferred insulation 8 is concrete heavily laden with water.

As is known in the art, combination lock 5 includes a manual actuator in the form of a rotatable knob 10 mounted on the exterior of the door 1. The knob 10 can be made of resinous material and can include a scaled dial, preferably using a scale numbered from 1 to 100 in increments of one. The knob 10 is preferably attached by insert molding to a spindle 11 that extends through the door 1. The inner or rearward region of spindle 11 is in turn connected to a series of tumbler discs 12 via a driver 13. The tumbler discs 12 are rotatably mounted coaxially with the spindle 11 on the back or interior region of the door 1. The driver 13 retains, engages, and drives the tumbler discs 12 about the combination lock spindle 11 so that they can be operated to selectively lock and unlock the safe.

Figure 4:
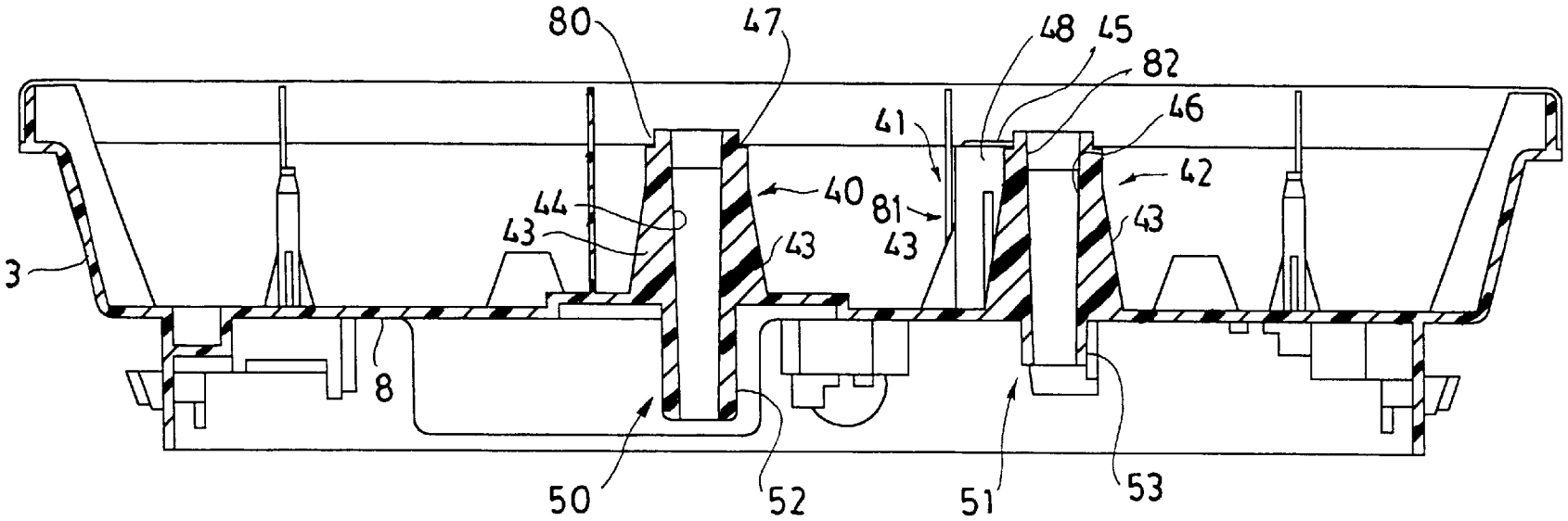
FIG. 4 is a cross section of the jamb and bushing system of the invention alone taken along line 3—3 in FIG. 2.
Figure 5:
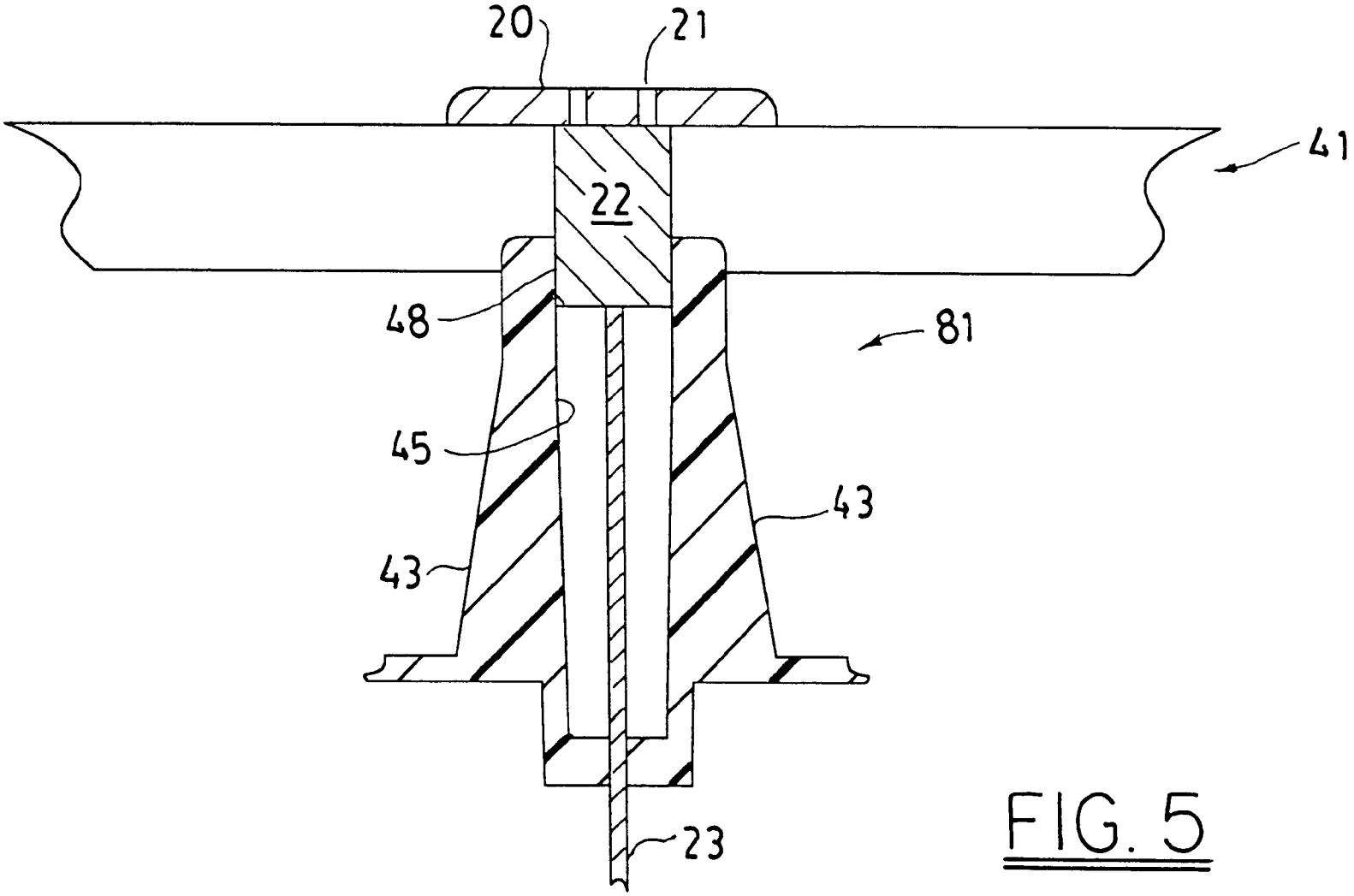
FIG. 5 is a cross section of the invention taken along line 5—5 of FIG. 1 and shows a cross section of the day lock bushing.

With particular reference to FIGS. 1,4, and 5, the preferred embodiment includes a key-operated day lock 6, that includes a front plate 20, a manual actuator in the form of a keyhole 21 in the front plate 20, a lock body 22, and a link 23 on the interior of the door 1. The day lock 6 can be used to lock the safe without locking combination lock 5 when, for example, the safe is left unattended for short periods. When the lock 6 is operated with its key, the key-operated lock body 22 and link 23 can be removed to prevent the handle 7 from actuating a live bolt system 31.

The handle 7 is attached to a spindle 30 and is itself a manual actuator that operates the live bolt system 31 mounted on the interior surface of the door 1. The handle 7 is preferably made of resinous material and insert molded onto the spindle 30. When the handle 7 is rotated, the handle spindle 30 also rotates causing the live bolts 32 of the live bolt system to move into or out of a locked position.

Opposite ends of the combination lock spindle 11 and handle spindle 30 preferably have the same configuration. This makes insertion of the spindles 11, 30 into the lock knob 10 and handle 7 much easier since it does not matter which end is inserted into the respective component. The spindles 11, 30 are also preferably made from resinous material, allowing attachment to other components by insert molding. The spindles 11, 30 can also have a square cross section over most of their extent to better accommodate the molding process. An advantage of square spindles is that they provide better drive connections at their ends than round spindles.

The bushings 40, 41, 42 include pass-through tube portions 80, 81, 82 extending from the back of front door plate 2 to the jamb 3. Each spindle 11, 30 extends through and is supported by a respective pass-through tube portion 80, 82. The key lock pin 23 extends through the pass-through tube portion 81. The tube portions 80, 81, 82 preferably have supporting ribs 43 arranged around their outer surfaces and extending into the insulation 8 for extra support.

To facilitate removal from a mold during manufacture of the jamb, the inner surfaces 44, 45, 46 of the pass-through tube portions 80, 81, 82 preferably include a draw. This gives the inner surfaces 44, 45, 46 of the tube portions 80, 81, 82 substantially frustroconical cross sections as shown in FIGS. 3 and 4. In the preferred embodiment, the inner diameters of the front or forward regions of the tube portions 80, 81, 82 are larger than the inner diameters of their respective rearward or inner regions. The very front regions of tube portions 80, 81, 82 preferably have cylindrical inner surfaces that provide running fits with the outside components. The combination lock knob 10 and the handle 7 carry spindle sleeves 101, 102 engaging the front regions of tube portions 80, 82, respectively. The front region of the tube portion 81 supports the key lock body 22. An additional running fit is provided for the spindles 11, 30 and the link 23 at the rearward ends of the tube portions 80, 82, and 81, respectively, preferably in the form of a line contact along a circumference of each spindle or link. If square spindles are used, the running fits are achieved by the corners of the spindles running against the interior surface of the rearward ends of the tube portions 80, 81, 82.

Inner end or rearward portions 50, 51 of the combination lock and handle bushings 40, 42, respectively, extend rearwardly beyond the rear wall 9 of the jamb 3 to form stub or sleeve portions (52, 53) for mounting of components of the combination lock 5 and the live bolt system 31. The outer surfaces (47, 48) of the inner end portions 50, 51 of the bushings 40, 42 are preferably substantially cylindrical to provide running fits with components mounted thereon. For example, the inner end portion 50 forms the stub or sleeve 52 of the combination lock bushing 40 and carries tumbler discs 12 on its cylindrical outer surface 47.

Four posts 60 on the jamb 3 cooperate with clips 70 on the door plate 2 to hold the jamb 3 and door plate 2 together in spaced-apart relation. The posts 60 are preferably formed integrally with the jamb 3 by suitable portions of the mold for jamb 3. The clips 70 are preferably welded to the door plate 2, but any suitable means of attachment can be used. Holes are provided in the door plate 2 such that, when the jamb 3 is clipped to the door plate 2, the bushings 40, 41, 42 are aligned with the holes. While clips are preferred, any suitable means of attachment can be used to hold the door plate 2 and jamb 3 together. The space between the door plate 2 and the jamb 3 is filled with insulation 8 after the plate 2 and jamb 3 are clipped together or otherwise attached to each other.

The bushings 40, 41, 42 are formed integrally with the jamb 3, preferably by injection molding with a single mold. The mold includes portions that form the jamb 3 and the bushings 40, 41, 42 so that the entire system is formed in one step. Thus, the bushings 40, 41, 42 do not need to be installed after the jamb 3 is mounted on the door plate 2 since they are installed as one with the jamb 3. This eliminates the time-consuming and inaccurate job of installing and aligning separate bushings, each with multiple parts. For those who would ordinarily use bushings that are mounted after the insulation is poured, the step of drilling mounting bores through the insulation is also eliminated.

With our bushing system, because the bushings 40, 41, 42 are part of the jamb 3, proper orientation and alignment of the bushings 40, 41, 42 are determined by the mold used to form the jamb 3 and bushings 40, 41, 42. Thus, the only sources of error are reduced to the mold and the formation of holes in the front door plate 2 in which the outer components of the locks 5, 6 and the handle 7 are mounted. This is advantageous over prior art bushing systems that rely on installation of individual bushings during or after assembly of the door since each separate step of bushing installation is a possible source of error.

The entire jamb/bushing system, including the spindles, is preferably made from resinous material, such as polycarbonate. Heat conduction to the safe interior is therefore low compared to that conducted by bushing systems using metal parts. As a result, our bushing system allows the safe interior to remain cooler longer than prior art bushing systems using metal parts. Also, the use of resinous material reduces manufacturing costs and allows great flexibility in jamb and bushing system design.

PARTS LIST

1 Door
2 Front door plate

3 Jamb
4 Hinge
5 Combination lock
6 Key lock (key-operated day lock)
7 Handle
8 Insulative material
9 Rear wall of jamb
10 Knob
11 Lock spindle (combination lock spindle)
12 Tumblers (tumbler discs)
13 Driver (tumbler driver)
20 Front plate (key lock front plate)
21 Keyhole
22 Key lock body
23 Key lock link
30 Handle spindle
31 Live bolt system
32 Live bolts
40 Combination lock bushing
41 Key lock bushing
42 Handle bushing
43 Ribs
44 Inner surface of combination lock bushing
45 Inner surface of key lock bushing
46 Inner surface of handle bushing
47 Outer surface of combination lock bushing
48 Outer surface of key lock bushing
49 Outer surface of handle bushing
50 Inner end portion of combination lock bushing
51 Inner end portion of handle bushing
52 Stub/sleeve of combination lock bushing
53 Stub/sleeve of handle bushing
60 Mounting post of jamb
70 Mounting clip of door plate
80 Pass-through tube portion of combination lock bushing
81 Pass-through tube portion of key lock bushing
82 Pass-through tube portion of handle bushing
101 Combination lock knob spindle sleeve
102 Handle spindle sleeve

We claim:

1. A door bushing system for an insulated steel shell safe, the system comprising:

a. a molded resin jamb secured to a steel front plate of a safe door so that a wall of the jamb enclosing an insulation space is rearward of the front plate;

b. a handle bushing and a lock bushing formed on the jamb to extend rearwardly of the jamb wall and forward of the jamb wall to the plate;

c. a handle spindle for a handle and a lock spindle for a lock, the spindles extending respectively through the handle bushing and the lock bushing from regions forward of the front plate to regions rearward of the bushings;

d. a handle on the handle spindle having a running fit in a forward region of the handle bushing;

e. a lock knob on the lock spindle having a running fit in a forward region of the lock bushing;

f. the handle spindle and the lock spindle having running fits in rearward regions of the respective handle and lock bushings;

g. a lock driver mounted on a rearward region of the lock spindle to engage lock tumblers mounted on a rearward region of the lock bushing; and h. a live bolt driver mounted on a rearward region of the handle spindle to have a running fit on a rear region of the handle bushing.

2. The system of claim 1 wherein the forward regions of the bushings have larger inside diameters than the rearward regions of the bushings.

3. The system of claim 1 wherein the handle and the lock are formed with spindle sleeves that fit forward regions of respective handle and lock bushings.

4. The system of claim 1 wherein the handle and the lock knob are molded respectively onto the handle and lock spindles.

5. The system of claim 1 wherein opposite ends of the spindles have the same configurations.

6. The system of claim 1 wherein the rearward regions of the bushings have cylindrical outside surfaces.

7. The system of claim 1 wherein the forward regions of the bushings have cylindrical inner surfaces.

8. The system of claim 1 wherein a day lock bushing is molded on the jamb to extend between the rear wall and the front plate to receive and support a portion of a key-operated day lock.

9. In a door of an insulated steel shell safe, a system aligning rotatable components of the door including a lock and a handle, the door having a front plate with openings therein, the system comprising:

a. molded resin bushings formed as a single piece with a molded resin jamb secured to the front plate, the bushings extending from the openings in the front plate to a rear wall of the jamb and rearward of the rear wall, manual actuators of the lock and the handle being fixed on respective lock and handle spindles passing through respective ones of the openings in the front plate and through respective molded resin bushings;

b. the manual actuators having running fits in the respective bushings in portions of the bushings adjacent the front plate, and the spindles having running fits in the bushings rearward of the rear wall; and c. lock components mounted on the lock spindle and lock bushing rearward of the rear wall, and live bolt driving components mounted on the handle spindle and handle bushing rearward of the rear wall.

10. The system of claim 9 wherein the manual actuators are molded onto the lock and handle spindles.

11. The system of claim 9 wherein opposite ends of the spindles have the same configurations.

12. The system of claim 9 wherein regions of the bushings rearward of the jamb wall have cylindrical outside surfaces.

13. The system of claim 9 wherein regions of the bushings near the front plate have cylindrical inside surfaces.

14. The system of claim 13 wherein the manual actuators have sleeves extending around the lock and handle spindles, and the sleeves have running fits in the bushings.

15. The system of claim 9 wherein forward regions of the bushings have larger inside diameters than rearward regions of the bushings.

16. The system of claim 9 wherein a day lock bushing is molded on the jamb to extend between the rear wall and the plate to receive and support a portion of a key-operated day lock.

17. An insulated steel shell safe door having a molded resin jamb secured to a steel front plate so that a rear wall of the jamb encloses an insulation space rearward of the front plate, the door comprising:

a. lock and handle bushings molded on the jamb to extend between the rear wall and respective lock and handle openings in the front plate;

b. lock and handle spindles extending respectively through the lock and handle bushings from forward of the front plate to rearward of the rear wall;

c. a knob on the lock spindle engaging a forward region of the lock bushing, and a lock driver on the lock spindle engaging a rearward region of the lock bushing rearward of the rear wall of the jamb; and d. a handle on the handle spindle engaging a forward region of the handle bushing, and a live bolt driver on the handle spindle engaging a rearward region of the handle bushing rearward of the rear wall of the jamb.

18. The door of claim 17 wherein the lock knob is molded on the lock spindle and has a sleeve extending around the lock spindle to provide a running fit in the forward region of the lock bushing.

19. The door of claim 18 wherein the forward region of the lock bushing has a cylindrical inside surface.

20. The door of claim 17 wherein the handle is molded on the handle spindle and has a sleeve extending around the handle spindle to provide a running fit in the forward region of the handle bushing.

21. The door of claim 20 wherein the forward region of the handle bushing has a cylindrical inside surface.

22. The door of claim 17 wherein opposite ends of the spindles have the same configurations.

23. The door of claim 17 wherein lock components have a running fit on a cylindrical outside surface of a region of the lock bushing rearward of the rear wall.

24. The door of claim 17 wherein the live bolt driver has a running fit on a cylindrical outside surface of a region of the handle bushing rearward of the rear wall.

25. The door of claim 17 wherein the forward regions of the bushings have larger inside diameters than the rearward regions of the bushings.

26. The door of claim 17 wherein the spindles have respective running fits within rearward regions of the bushings.

27. The door of claim 17 wherein a day lock bushing is molded on the jamb to extend between the rear wall and the plate to receive and support a portion of a key-operated day lock.

28. In an insulated steel shell safe door including a front door plate with openings therein that allow door components to pass therethrough, a bushing system comprising:

a bushing formed integrally with a resinous jamb, the jamb having a front side facing and in part confronting the front door plate, the jamb also having a rear side facing away from the front door plate, the jamb further including a rear wall, the bushing comprising:

a pass-through tube portion extending from a front side of the rear wall to the front door plate substantially in alignment with one of the openings in the front door plate; and a stub portion coaxial with and projecting rearwardly beyond the pass-through tube portion and rearward of the rear wall of the jamb as an extension of the bushing and being adapted to support a part of a door component another part of which extends through the bushing.

29. The bushing system of claim 28 wherein the pass-through tube portion has a draw over substantially a majority of a length of the pass-through tube portion that is substantially frustroconical in cross section.

30. The bushing system of claim 29 wherein an inner diameter of a front part of the pass-through tube portion is larger than an inner diameter of a rear part of the pass-through tube portion.

31. The bushing system of claim 28 wherein a rotatable spindle is mountable within the pass-through tube portion of the bushing.

32. The bushing system of claim 31 wherein an inner surface of a front region of the pass-through tube portion is substantially cylindrical and provides a running fit for a safe component attached to the spindle.

33. The bushing system of claim 31 wherein an inner surface of the step portion provides a running fit with the spindle.

34. The bushing system of claim 31 wherein the spindle carries a driver on a rear portion.

35. The bushing system of claim 28 wherein the stub portion has an outer surface that is substantially cylindrical.

36. The bushing system of claim 28 wherein supporting ribs extend to the rear wall from the pass-through tube portion.

37. The bushing system of claim 28 wherein the bushing system is formed by the process of injection molding the bushing system from a single mold adapted to form the bushing as well as the jamb.

* * * * *